United States Patent [19]

Koziol et al.

[11] 4,086,157

[45] Apr. 25, 1978

[54] ELECTRODE FOR ELECTROCHEMICAL PROCESSES

[75] Inventors: Konrad Koziol, Rothenbach an der Pegnitz; Karl-Heinz Sieberer, Zirndorf uber Nurnberg; Hans-Carl Rathjen, Rothenbach an der Pegnitz, all of Germany

[73] Assignee: C. Conradty, Germany

[21] Appl. No.: 677,083

[22] Filed: Apr. 15, 1976

Related U.S. Application Data

[63] Continuation-in-part of Ser. No. 438,388, Jan. 31, 1974, abandoned, and a continuation-in-part of Ser. No. 234,846, Mar. 15, 1972, abandoned.

[51] Int. Cl.[2] ..... C25B 11/10

[52] U.S. Cl. ..... 204/290 F

[58] Field of Search ..... 204/290 F, 290 R

[56] References Cited

U.S. PATENT DOCUMENTS

| | | | |
|---|---|---|---|
| 1,302,959 | 5/1919 | Page | 204/290 R |
| 2,305,539 | 12/1942 | Lowry | 204/290 R |
| 2,882,213 | 4/1959 | Douglas | 204/197 |
| 3,632,497 | 1/1972 | LeDuc | 204/263 |
| 3,677,917 | 7/1972 | Martinson | 204/99 |
| 3,706,644 | 12/1972 | Martinsons | 204/98 |

*Primary Examiner*—F.C. Edmundson

*Attorney, Agent, or Firm*—Gifford, Chandler, Sheridan & Sprinkle

[57] ABSTRACT

A coated valve metal electrode for electrochemical processes, which has (a) an electrode base body of valve metal; (b) a base layer on said valve metal, said base layer comprising an electrically conducting element without valve effect, and (c) a cover layer comprising titanium dioxide and/or tantalum oxide with certain doping and stable oxides.

15 Claims, 2 Drawing Figures

ELECTRODE FOR ELECTROCHEMICAL PROCESSES

Figure 1:
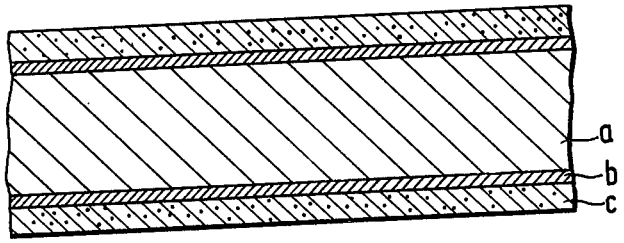

The present application is a continuation-in-part application of co-pending application Ser. No. 438,388 filed Jan. 31, 1974 now abandoned. The latter application was a continuation-in-part of abandoned application Ser. No. 234,846, filed Mar. 15, 1972 now abandoned.

The present invention relates to an electrode for electrochemical processes. While the electrode according to the present invention may be used in connection with numerous electrolysis processes, it will, by way of example, be described in connection with the electrolysis of brines.

The present advanced state of development of the new giant cells; which state of development is reflected primarily in the low cell voltages, the high current and efficiency of energy usage, in the ease of servicing, and in the safety of operation of electrolysis installations; is the result of a number of developments and improvements which to a great extent also concern the anodes.

Technical anode materials have to meet a number of requirements. These requirements primarily concern the corrosion resistance and mechanical strength of the anode materials and the ability to maintain the anode process at a sufficiently high speed and at a minimum of excess voltage. The heretofore industrially employed anode materials meet these requirements only partially. Thus, during the operation of graphite anodes a certain unavoidable burning off or consumption takes place. With modern giant cells this calls for expensive devices in order to maintain a constant gap between anode and cathode. Furthermore, considerable expenses are involved in cleaning the brine.

Aside from graphite anodes, anodes of platinum and of metals of the platinum group or other alloys have also been employed. These anodes have the drawback that they require high investment costs and suffer from a relatively high degree of burning off of precious metals. Moreover, the limited supply of platinum metals has not been sufficient to meet the greatly increased need for anodes for electrochemical processes. For this reason anodes of platinized titanium have recently become known. The latter, however, have failed in the field of mercury-electrolysis on account of the great sensitivity to amalgam and in connection with diaphragm cells on account of insufficient stability.

It is known that valve metals such as titanium, tantalum, niobium, zirconium, etc. passivate rapidly when used in aqueous solutions by the formation of a tight oxidic cover layer, which makes them exceedingly corrosion-resistant in many electrolytes. The passive layers of these metals, however, have no electron conductivity in the potential ranges coming into consideration in the present case, so that very high field intensities occur in the layers which leads to destruction of the passivating layers above a break-down potential. Although said metals have good corrosion resistance, an anode process thus cannot be carried through on these passive metals. The designation "valve metal" is based on the fact that the metal covered with the passive layer conducts the current well in one direction only. The latter is also referred to as the rectifier effect, tube effect or valve effect.

Similarly, the precious metals, when subjected to higher potentials in a solution of electrolytes, become covered with passive layers. With platinum, just a monomolecular oxygen-chemical absorption layer (Chemisorptionsschicht) on the metal surface will bring about a passivation. For this passive layer mechanism it is immaterial whether the described oxidic cover layer on the precious metal is created in the electrolyte, or whether precious metal oxidic layers are applied prior to the employment in the electrolysis. These passive layers, in contrast to the passive layers of valve metals, have a satisfactory electron conductivity and thus permit the carrying out of an anode process.

This finding is the basis of the two German Offenlegungsschriften No. 1,814,567 and No. 1,814,576 which suggest the employment of an electrode of a valve metal with a platinum metal oxide-containing layer of a non-precious metal oxide. The precious metal oxide component is here believed to have the function of a chlorine freeing catalyst and of a doping agent. In addition to protecting these cover layers which contain precious metal oxide, protection of ceramic semi-conductor cover layers, which are free of precious metal oxides, is sought although it would appear from the aforementioned Offenlegungsschriften that on cover layers of this latter kind the anode process takes place with a far less favorable potential. Applicant's own tests have confirmed this drawback of the precious metal-free cover layers on a base of a valve metal and have shown that the increased anode potential very quickly leads to a passivation and destruction of the coated electrode. It is for this reason that valve metal electrodes covered by oxidic coatings which are free of precious metal oxides have not been adopted in industry. The platinum metal oxide containing coatings, for instance ruthenium oxide-containing ceramic semi-conductor coatings according to the German Offenlegungsschriften No. 1,814,567 and No. 1,814,576 have the well known economic drawbacks which result from the employment of precious metal, namely high price of the coating layers, high investment costs and high operating costs, especially when the anodes fail.

In view of the above-mentioned drawbacks of the precious metals and precious metal oxides, the losses occurring during the electrolysis process are rather high. Recently, anodes have become known in which the precious metals and/or precious metal oxides are coated with non-conductive enamels of porous, fireproof, non-conductive oxides for protection against mechanical, chemical and electrochemical wear. In view of this insulating coating or cover layer, however, the local current density on the anode is increased and the electrode works at the same load with a higher anode potential than an anode without cover layer or coating.

Moreover, anodes are known which are provided with a spinel-surface with binders on a conductive base metal. The use of the electrically isolating binders is resulting in an increase of loss of voltage in the layer and also in an increase of the local current density at those ranges of the layer which are showing the more efficient conductivity. These two reasons lead to the further fact these anodes are also operating under increased anode potential.

It is therefore, an object of the present invention to provide an electrode which will not have the above-mentioned drawbacks.

Figure 2:
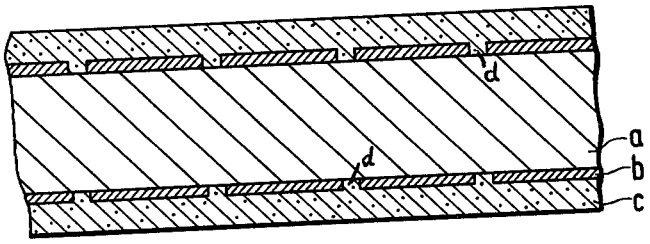

This object and other objects and advantages of the invention will appear more clearly from the following specification in connection with the accompanying drawing, in which:

FIG. 1 is a section through a first embodiment of an anode according to the invention; and FIG. 2 is a section through a second embodiment of an anode according to the invention in which the base layer is divided by grooves into segments.

The coated or covered valve metal electrode according to the present invention for electrochemical processes includes (a) a base member of valve metal, such as titanium, tantalum, niobium, zirconium and alloys thereof as well as (b) a base layer and (c) a cover layer or coating. Said base layer consists of at least one of the metals having no valve effect, for example cadmium, silver, gold, platinum, ruthenium, palladium and/or carbon. Said cover layer is gas-tight and liquid-tight and comprises:

1. a valve metal oxide selected from the group consisting of titanium dioxide and tantalum oxide;

2. a doping material to increase the electrical conductivity of said valve metal oxide and comprising, when titanium dioxide is said valve metal oxide, an oxide selected from the oxides of niobium, tungsten, molybdenum, antimony, and tin and comprising, when tantalum oxide is said valve metal oxide, an oxide selected from the oxides of tungsten, molybdenum, antimony, and tin;

3. at least one of the oxides stable in an electrolysis medium selected from the oxides of barium, gallium, germanium, lead, bismuth, selenium, tellurium, copper, cadmium, the rare earth elements, manganese, iron, cobalt, and nickel;

wherein the proportion of said doping material in said valve metal oxides is less than about 28 mol percent of the mixture, and the proportion of said stable oxides in said cover layer is greater than about 50 mol percent.

This structure prevents contact of the base layer with the electrolyte. The presence of the cover layer makes it possible to utilize much less precious metal for the base layer than if the anode process occurs directly on the precious metal layer. Thus one achieves a drastic reduction in costs when producing the electrode according to the invention. Due to the fact that the base layer has no direct contact with the electrolyte, it is now possible for the first time to apply onto the valve metal-base member also such materials as normally are subjected to wear in electrolysis, such as non-precious metals and graphite which, however, meet the essential requirement that the valve metal-base member does not oxidize during the coating procedure and in use. Furthermore, the base layer also must prevent passivation of the valve metal-base member by a penetrating electrolyte in the case where the cover layer no longer is completely tight so that the electric current can safely be conducted from the valve metal-base member to the cover layer. No expensive precious metals are contained anymore in the cover layer of the anode according to the invention and, therefore, said layer can be relatively thicker to contribute to long operational periods. Besides the fact that the costs for manufacturing the electrode according to the invention are low, its cover layer considerably increases the amalgam resistance as compared with a conventional precious metal anode.

Electrically conductive oxides of non-precious metals that are particularly stable chemically and electrochemically in the electrolysis medium are suited for the production of said cover layer. The oxides of titanium and tantalum are known to be stable in the electrolysis medium, but titanium-dioxide and tantalum pentoxide are very poor electrical conductors. The classic methods for increasing the electrical conductivity in these poorly conductive oxides consist of doping the oxides with an oxide of a metal of different valency or highly contaminating them with electrically well conductive oxides. The oxides of tantalum, niobium, tungsten, molybdenum, antimony, and tin are suited for this purpose for titanium dioxide. Although experience has shown that the thus doped titanium or tantalum oxides are not suited for the production of an electrically conductive surface on a valve metal-base member for carrying through an anode process, it surprisingly has turned out that said materials are suited as electrode materials if a particular, likewise conductive layer is interposed between the valve metal and said conductive oxides, such as is the case with the electrodes as according to the invention. It has been shown to be advantageous to combine said conductive valve metal oxides with oxides of the spinel-type, particularly because the latter additionally increase the conductivity of the valve metal oxides. Spinels are oxides of non-precious metals of the type $R_3O_4$, wherein R usually is one or more bivalent metals such as magnesium, calcium, strontium, barium, tin, lead, copper, cadmium, rare earths, magnanese, iron, cobalt and nickel, and one or more trivalent metals, such as gallium, antimony, bismuth, rare earths, manganese, iron, cobalt and nickel. In the case of the spinels with monovalent and tetravalent metals, the metals germanium, selenium and tellerium still occur. Oxides and mixed oxides of another type, such as for example such having perovskite-structure are also suited for combination with the valve metals oxides that have been made conductive if their chemical and electrochemical stability as well as their electric conductivity is good.

Because of the fact that the oxides of the spinel-type, as well as also the oxides of other structures, may obviously also be present in the form of separately produced solid particles within the cover layer; and because of the necessity of maintaining the electrical conductivity and the electrochemical stability; and because the valve metal oxides which are doped with at maximum 28 mol percent foreign materials function as binders; it is useful, that the proportion of oxides of metals without valve effect, which are electrically conductant and stable in the electrolysis medium, comprises at least about 50 mol percent of the cover layer. Thus, long life, good activity and economy of the cover layer of the anode are assured. It was found that a mixture of 70 mol percent titanium oxide and 30 mol percent antimony oxide could not be provided in any way with the good properties of the above mentioned cover layer even if 75 mol percent of the cover layer comprised the stable, electrically conductant oxides.

It has been shown to be useful for the cover layers according to the invention, to produce the base layer of materials without valve effect which have good electrical conductivity and from oxides having good conductivity or also being slightly volatile. Thus, for example precious metals such as gold, silver and platinum metals, non-precious metals such as cadmium and cadmium alloys as well as also various types of carbon are suited as materials for said base layer. If the base layer consists of a material that can be destroyed upon electrolysis in case the electrode cover layer is damaged (e.g. by a short circuit or mechanical influences), it will be useful to section said base layer at suitable spacings by grooves and to separate the individual fields from one another by filling out said grooves with the insoluble cover layer. It is ensured by such a measure that in the case of damage only the respective field fails and the remaining part of the electrode continues to operate.

The present invention will now be explained in connection with the accompanying drawing and examples which, however, are given by way of example only and do not represent any limitation.

Referring now to the drawings in detail, FIG. 1 shows a longitudinal section through an anode which comprises a valve metal base body *a*, a base layer *b* composed of metals without valve effect and/or of carbon. The anode shown in FIG. 1 furthermore comprises a cover layer *c* composed of electrically conductive oxides of non-precious metals.

The modification shown in FIG. 2 differs from that of FIG. 1 in that the base layer *b* is by means of grooves *d* divided into fields.

The anode of FIG. 1 involves precious metal and the anode of FIG. 2 involves non-precious metal. In FIG. 2 there are grooves or interruptions *d* so that if any corrosion or eating away occurs this will be limited to only one part or location rather than all over. There is to be understood that grooves *d* can also be referred to as interruptions in the base layer which is thereby divided into a number of fields or areas. This is to permit valve metal exposing and protection in differing parts or locations.

Titanium, though relatively inexpensive, cannot be used in a condition or state wherein it is not covered. Tantalum is very expensive and therefore it requires coating with other oxide material to give it protection.

EXAMPLE 1

A titanium sheet having the dimensions 100 × 100 × 1 mm is etched for 60 minutes in the steam of a boiling 20% hydrochloric acid and is then rinsed with water and dried. On the thus pretreated sheet a thin layer of metallic platinum is, in the form of a base layer, galvanically deposited from a commercially available bath. Thereupon, a solution of 39.8 g $FeCl_2 \times 4\ H_2O$, 26.2 g $Co(NO_3)_2 \cdot 6\ H_2O$, 22.6 g $Mn(NO_3)_2 \cdot 4\ H_2O$, 20.3 g $SnCl_2 \cdot 2\ H_2O$ and 86.0 g $TaCl_5$ in HCl to which $H_2O_2$ in excess was added, is prepared and 20 layers of this solution are applied to the platinated sheet and each layer is for 15 minutes burnt-in at a temperature of 400° C. After the last layer has been applied the electrode is burnt-in for 30 minutes at a tempterature of 450° .

Anodes prepared in conformity with this example have still been working satisfactorily after approximately 4500 hours of operation in a NaCl-laboratory cell without ascertainable increase in the cell voltage.

The foremost advantage of an anode according to the present invention became apparent when employing an anode prepared in conformity with the invention in a 20% HCl-electrolyte at an operating temperature of 70° C. After a 4 month electrolysis duration, this electrode did not show any decrease in its working manner, whereas a platinum coated electrode which was produced with the same bath as the base layer, and in the absence of the cover layer of the invention, was after such a period of operation already inactive to a major degree. Also a ruthenium oxide anode similarly prepared showed after the same period of operation a clear increase in cell voltage.

EXAMPLE 2

A titanium sheet having the dimensions 100 × 100 × 2 mm is for 10 minutes etched in a 50% hydrofluoric acid, is then rinsed with water and dried. Galvanically deposited upon this plate is a thin layer of metallic ruthenium. Thereupon a solution is prepared from 38.9 g $FeCl_3$, 23.8 g $CoCl_2 \cdot 6H_2O$, 35.6 g $MnCl_2 \cdot 4H_2O$ and 32.4 g $TiCl_3$ in 1 liter of 3% hydrochloric acid. Added to this solution is a 30% $H_2O_2$ until a continuous slight gas development due to excessive $H_2O_2$ can be noticed. Thereupon 18.9 g of $NbCl_5$ completely dissolved in $H_2O_2$ are added to the thus obtained solution. The $NbCl_5$ solution must not contain any components in colloidal form. Possibly occurring $Nb_2O_5$ must be carefully removed from the solution and the corresponding niobium quantity has to be supplemented. Thereupon this solution is evenly distributed to 20 containers. The immersed titanium sheet is by means of a lifting motor at a speed of approximately 5 cm/min pulled out of the solution and the cover layer is burned-in for 15 minutes at a temperature of 400° C. For purposes of applying the next layer, the next container is used, and the burning-in operation of the next layer is repeated. After in this manner twenty layers, each having a thickness of 1 micromillimeter, have been applied to the metal sheet, an annealing operation is carried out at 500° C for a period of 1 hour. This mode of application will assure that no parts of the base layer will be found in the cover layer.

An anode produced in conformity with this example works in an NaCl-electrolyte at a current density of 6.7 $kA/m^2$ after 5000 hours at a cell voltage of 4.1 volts.

EXAMPLE 3

For purposes of preparing the base layer, from a solution of 51.5 g ruthenium chloride and 50 g $TiCl_3$ in 1 liter of a 20% hydrochloric acid there are deposited upon a titanium plate pre-etched in conformity with Example 1, four layers and each layer is burned-in in an argon atmosphere for 15 minutes at a temperature of 500° C. From a solution of 85.5 g $FeCl_2 \cdot 4H_2O$, 69.8 g $Co(NO_3)_2 \cdot 6H_2O$, 32.6 g $Mn(NO_3)_2 \cdot 4H_2O$, 2.3 g $SnCl_2 \cdot 2H_2O$ and 74.0 g $TiCl_3$ in 2 liters of a 3% HCl which has been mixed in excess $H_2O_2$ and in addition thereto contains 4.6 g $SbCl_5$, there are further deposited as cover layer 18 coats and each coat is burned-in at a temperature of 350° C. for a period of 20 minutes.

An electrode produced in this manner worked fully satisfactorily for a period of operation of 3000 hours, whereas an electrode upon which only ruthenium containing layers had been deposited showed already during this short period of operation a considerable increase in voltage.

EXAMPLE 4

A cadmium layer is galvanically deposited upon a tantalum plate of the size of 100 × 100 × 2 mm which was etched in a 50% hydrofluoric acid. This cadmium layer is divided by grooves having a width of 2 mm and extending to the tantalum plate to divide the cadmium layer into squares of the size of 5 × 5 mm. Thereupon there is prepared one liter of a sulfuric acid solution containing 121.3 g $La_2(SO_4)_3 \cdot 6\ H_2O$, 78.4 g $GeBr_4$, 30.4 g $MnSO_4 \cdot H_2O$, 28.1 g $CoSO_4 \cdot 7H_2O$ and 76.6 g $Ti_2(SO_4)_3$, the latter being added in the form of a commercially available titanium sulfate solution. To this solution is added a 30% $H_2O_2$ until a steady slight gas development can be observed. Thereupon 20 g of a barium phosphor tungstate produced according to a standard method are dissolved in hot water. While HCl is added the barium is precipitated by sulfuric acid, barium sulfate to a large extent is filtered out, and the filtrate is added, to the above-mentioned solution. Thirty layers are deposited and each layer is burned-in at 380° C. After the last layer has been deposited, a final heat treatment is carried out at 500° C for a period of 60 minutes.

The use of an anode according to this example within a weak sulphuric acid electrolyte leads even after a long operation to no ascertainable increase in voltage. Anodes wherein the cover layer contains, instead of lanthanum oxide, other rare earth oxides yield similar advantageous results.

EXAMPLE 5

A pre-etched titanium rod having a diameter of 10 mm. and a length of 20 cm. is coated with carbon in a customary manner to a depth of 2 cm. The carbon layer is milled into grooves having a depth of approximately 1 mm. Thereupon, from a solution of 238.6 g $FeCl_2 \cdot 4 H_2O$, 174.6 g $Co(NO_3)_2 \cdot 6 H_2O$, 150.6 g $Mn(NO_3)_2 \cdot 4 H_2O$, 190.2 g $NiCl_2 \cdot 6 H_2O$, 136.4 g $CuCl_2 \cdot 2 H_2O$, 36.1 g $WCl_5$ and 138.8 g $TiCl_3$, 20 layers are deposited and each layer is burnt-in at a temperature of 350° C. for a period of 15 minutes.

An anode made according to this method worked in the laboratory cell at a voltage of 4.2 volts with a current density of 10 kA/m$^2$. After a period of operation of 500 hours, the coating or cover layer, was damaged at some places with a chisel. After an additional operation over a period of 1000 hours, it was found that the activity at the damaged areas had decreased whereas the other areas were working in an undiminished satisfactory manner. If therefore the base layer consists of a material which can be destroyed by the electrolysis, when the cover layer of the electrode is damaged, for instance, by short circuit or mechanical influences, then it will be useful to interrupt this base layer in suitable distances and to separate the several segments from one another by inserting the insoluble cover layer. Such a measure has the effect that on the occurence of damage only single segments break down, whereas the remaining part of the electrode continues operation.

EXAMPLE 6

A base layer of poly crystalline graphite is deposited upon a titanium plate having the size of 100 × 100 × 2mm. Thereupon a solution of 6.9 g $Se_2Cl_2$, 8.1 g $Fe(NO_3)_3 \cdot 9H_2O$, 2.5 g $Mn(NO_3)_2 \cdot 4 H_2O$, 2.9 g $Co(NO_3)_2 \cdot 6 H_2O$, 19.2 g $Ti_2(SO_4)_3$ and 3 g $SbCl_5$ is prepared in 200 ml. of a 3% sulfuric acid. To this solution is added in excess a 30% $H_2O_2$ until a slight gas development can be observed. From this solution there are deposited twenty layers, and each layer is burned-in at 300° C for a period of 15 minutes.

An anode prepared according to this method worked for eight weeks without any ascertainable loss in weight.

EXAMPLE 7

A platinum-carbon mixture is in a vacuum evaporated upon a titanium plate having the dimension of 50 × 10 × 2mm and etched at 90° C in a 10% oxalic acid. The proportion of precious metal amounts to 10% of the evaporated quantity. From a solution composed of 32g $FeCl_3$, 15g $CoCl_2 \cdot 6H_2O$, 25 g $MnCl_2 \cdot 4H_2O$, 60 g $TaCl_5$ and 15 g barium phosphor tungstate; from which the barium was removed in conformity with Example 5; in a liter of 3% HCl which contains $H_2O_2$ in excess, twenty layers are applied and each layer is at a temperature of 350° C burned-in for a period of 20 minutes.

An anode prepared according to this method operated at a current density of 10 kA/m$^2$ at a voltage of operation of 4.1 volts in the NaCl-electrolyte.

It is assumed that the high stability of the electrode described in Example 1 is due to the presence of the tantalum oxide. For example, a considerably better corrosion resistance of the titanium can also be attained by coating with tantalum oxide. If these tantalum oxide layers are sufficiently thick, it is thus possible to almost attain the corrosion resistance of pure tantalum, although the current leads and current distributors primarily consist of the considerably less expensive titanium. The advantages are attained particularly when used in hot hydrochloric acid electrolytes, for example in technical HCl-electrolysis, and sulphuric acid-containing electrolytes, for example in electrolysis of a sulphuric sodium sulphate solution, because, as is well known, a strong attack on the titanium oxide, in contrast to the tantalum oxide, is observed in said media.

The following example shows the production of such a particularly corrosion-resistant oxide layer:

40 layers of a hydrochloric-acid-containing solution are applied with 15 g $TiCl_3$ and 140 g $TaCl_5$, which contains an excessive amount of $H_2O_2$, are applied onto a titanium plate etched as in Example 1 and having the dimensions 100 × 100 × 2mm. Each layer is burned-in for 30 minutes at 400° C and after the last layer has been applied it is burnt again for 60 minutes at 700° C. It will turn out that the break-down voltage for this plate is considerably higher than for non-coated titanium sheets. This oxide layer is primarily suited for current leads and for such parts of the electrode structure arranged on the side facing away from the cathode and do not take part in the electrolysis process. For production of this coating of better corrosion resistance, one usefully selects a proportionately larger amount of the more resistant valve metal.

With respect to the cover layer of the invention it must be pointed out that whenever in the present application the term "cover layer" is used, the base layer and the cover layer may each consist of several single layers.

It may, however, be added that in the examples in which the thickness of each of the multiple layers has not been specifically mentioned, a layer thickness of from 0.5 to 1.00 micromillimeter per layer was found particularly satisfactory. It is, of course, to be understood that the present invention is, by no means, limited to the specific examples set forth above but also comprises any modifications within the scope of the appended claims.

We claim:

1. In an electrode for electrode processes and comprising a valve metal as a base member the improvement which comprises:

a. a base layer coated on said base member and comprising an electrically conductive chemical element having no substantial valve effect; and b. a gas-tight and liquid-tight cover layer on said base layer and comprising:

1. a valve metal oxide selected from the group consisting of titanium dioxide and tantalum oxide;
2. a doping material to increase the electrical conductivity of said valve metal oxide and comprising, when titanium oxide is said valve metal oxide, an oxide selected from the oxides of niobium, tungsten, molybdenum, antimony, and tin and comprising, when tantalum oxide is said valve metal oxide, an oxide selected from the oxides of tungsten, molybdenum, antimony, and tin;
3. at least one of the oxides stable in an electrolysis medium selected from the oxides of barium, gallium, germanium, lead, bismuth, selenium, tellurium, copper, cadmium, the rare earth elements, manganese, iron, cobalt, and nickel;

wherein the proportion of said doping material in said valve metal oxides is less than about 28 mol percent of the mixture and the proportion of said stable oxides in said cover layer is greater than about 50 mol percent.

2. The electrode as defined in claim 1 wherein said valve metal forming said base member is selected from the group consisting of titanium, tantalum, niobium, zirconium, and alloys thereof.

3. The electrode as defined in claim 1 wherein said electrically conductive chemical element is selected from the group consisting of cadmium, silver, gold, platinum, ruthenium, palladium, and carbon.

4. The electrode as defined in claim 1 wherein said valve metal oxide is titanium dioxide.

5. The electrode as defined in claim 1 wherein said valve metal is tantalum oxide.

6. The electrode as defined in claim 3 wherein said electrically conductive chemical element is carbon.

7. The electrode as defined in claim 1 wherein said valve metal forming said base member is selected from the group consisting of titanium, tantalum, niobium, zirconium, and alloys thereof; said valve metal oxide is titanium dioxide; and said electrically conductive chemical element is selected from the group consisting of cadmium, silver, gold, platinum, ruthenium, palladium, and carbon.

8. The electrode as defined in claim 1 wherein said valve metal is titanium, said valve metal oxide is titanium dioxide, and said electrically conducting chemical element is carbon.

9. The electrode as defined in claim 1 wherein said valve metal is titanium, said valve metal oxide is tantalum oxide, and said electrically conducting chemical element is carbon.

10. The electrode as defined in claim 1 comprising interruptions in said base layer in a manner to divide said base layer into a number of fields to in part expose said base member to and to in part separate said base member from said cover layer.

11. The electrode as defined in claim 4 comprising interruptions in said base layer in a manner to divide said base layer into a number of fields to in part expose said base member to and to in part separate said base member from said cover layer.

12. The electrode as defined in claim 7 comprising interruptions in said base layer in a manner to divide said base layer into a number of fields to in part expose said base member to and to in part separate said base member from said cover layer.

13. The electrode as defined in claim 1 wherein said stable oxides comprise a spinel.

14. The electrode as defined in claim 4 wherein said stable oxides comprise a spinel.

15. The electrode as defined in claim 7 wherein said stable oxides comprise a spinel.

* * * * *